US007770886B2

(12) United States Patent
Yoshiuchi

(10) Patent No.: US 7,770,886 B2
(45) Date of Patent: Aug. 10, 2010

(54) SHEET FEED TRAY AND IMAGE FORMING APPARATUS

(75) Inventor: Katsuhiro Yoshiuchi, Osaka (JP)

(73) Assignee: Kyocera Mita Corporation (JP)

( * ) Notice: Subject to any disclaimer, the term of this patent is extended or adjusted under 35 U.S.C. 154(b) by 189 days.

(21) Appl. No.: 11/712,007

(22) Filed: Feb. 28, 2007

(65) Prior Publication Data

US 2007/0200288 A1 Aug. 30, 2007

(30) Foreign Application Priority Data

Feb. 28, 2006 (JP) ..... 2006-053146

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 4,907,792 A * 3/1990 Washiashi et al. ..... 271/240
5,611,528 A * 3/1997 Nakamura et al. ..... 271/164
5,988,621 A * 11/1999 Kondo et al. ..... 271/3.02
6,116,591 A * 9/2000 Kim ..... 271/171
6,581,926 B2 * 6/2003 Hsiao et al. ..... 271/171
2003/0151188 A1 * 8/2003 Imahara ..... 271/171
2006/0022397 A1 * 2/2006 Kaneko et al. ..... 271/145
2006/0082044 A1 * 4/2006 Aida ..... 271/145
2007/0194517 A1 * 8/2007 Nose et al. ..... 271/171

FOREIGN PATENT DOCUMENTS

JP 9-272635 10/1997
JP 2002-240964 8/2002

* cited by examiner

*Primary Examiner*—Richard W Ridley
*Assistant Examiner*—Michael C McCullough
(74) *Attorney, Agent, or Firm*—Gerald E. Hespos; Michael J. Porco

(57) ABSTRACT

A sheet feed tray has a bottom plate on which a sheet is to be placed; two side fences for positioning opposite widthwise sides of a sheet placed on the bottom plate; and an interlocking mechanism for interlocking movements of the side fences toward and away from each other. The interlocking mechanism includes two racks integrally attached to the respective side fences with toothed surfaces thereof opposed to each other and movable along the bottom plate, and a pinion provided on the bottom plate. The pinion is rotatable about its central axis and is engageable with the pair of racks. Locking projections are disposed at the respective rack sides and project toward the bottom plate side. Contact portions are disposed at the bottom plate side and engage the locking projections with the pair of side fences maximally or minimally spaced apart from each other.

12 Claims, 5 Drawing Sheets

SHEET FEED TRAY AND IMAGE FORMING APPARATUS

BACKGROUND OF THE INVENTION

1. Field of the Invention

The present invention relates to a sheet feed tray to have sheets placed thereon and an image forming apparatus to which this sheet feed tray is applied.

2. Description of the Background Art

There has been conventionally known a sheet feed tray to have a stack of sheets placed thereon in order to feed sheets to an image forming apparatus as disclosed in Japanese Unexamined Patent Publication No. H09-272635 (hereinafter, document 1) or Japanese Unexamined Patent Publication No. 2002-240964 (hereinafter, document 2). Such a sheet feed tray includes a pair of side fences opposed to each other in widthwise direction normal to the conveyance direction of sheets and extending in the conveyance direction, a pair of racks fixed to the corresponding side fences, extending in width direction and having toothed surfaces opposed to each other, and a pinion interposed between the respective racks in such a manner as to be engaged with the teeth of the respective racks.

In this construction, one side fence is moved in width direction, whereby this movement is transmitted to the other side fence via one rack, the pinion and the other rack, with the result that the other side fence is moved by the same amount in opposite direction. The pair of side fences needs to be accurately positioned relative to each other beforehand in order to feed sheets held therebetween to a specified position in the image forming apparatus in such a state as not to be displaced in sheet width direction.

Accordingly, in the sheet feed tray of document 1, the respective side fences are engaged with the pinion while being stopped by stoppers or outer stoppers transversely symmetrically disposed with respect to the pinion in order to be accurately positioned at the time of assembling the sheet feed tray. Thus, the respective side fences are accurately positioned relative to each other.

Contrary to this, in the sheet feed tray of document 2, positioning index are provided at one side of the pair of racks integral to the respective side fences and at one side of the pinion engaged with the respective racks, whereas applicable range marks corresponding to these index are provided on the other sides, and the index are caused to conform to the applicable range marks upon assembling the racks and the pinion into the sheet feed tray. Thus, the respective side fences are arranged at proper positions on the sheet feed tray.

However, in the sheet feed tray of document 1, the positional relationship of the side fences may deviate from the proper one since the side fences are merely stopped by the inner or outer stoppers.

Further, in the sheet feed tray of document 2, the positions of the index vary within a range defined by the applicable range marks even if the index are positioned within range defined by the applicable range marks. Therefore, there still exists a problem that the respective side fences cannot be accurately positioned.

SUMMARY OF THE INVENTION

An object of the present invention is to provide a sheet feed tray in which a pair of side fences can be easily and securely positioned at the time of assembling a pinion and a pair of racks, and an image forming apparatus to which this sheet feed tray is applied.

In order to accomplish this object, one aspect of the present invention is directed to a sheet feed tray, comprising a bottom plate on which a sheet is to be placed; a pair of side fences for positioning the opposite widthwise sides of a sheet placed on the bottom plate; an interlocking mechanism for interlocking movements of the pair of side fences in directions toward and away from each other, the interlocking mechanism including a pair of racks integrally attached to the respective side fences with toothed surfaces thereof opposed to each other and movable along the bottom plate, and a pinion provided on the bottom plate rotatably about its central axis thereof and engageable with the pair of racks; locking projections disposed at the respective rack sides and projecting toward the bottom plate side; and contact portions disposed at the bottom plate side and engageable with the locking projections with the pair of side fences maximally or minimally spaced apart from each other.

Another aspect of the present invention is directed to an image forming apparatus, comprising an apparatus main body for applying an image forming process to a sheet; a sheet feeder attached to the apparatus main body to feed a sheet or a document to be read toward a specified position of the apparatus main body; and a sheet feed tray provided in the sheet feeder, adapted to bear the sheet or the document and having the inventive construction.

DETAILED DESCRIPTION OF THE PREFERRED EMBODIMENTS

Figure 1:
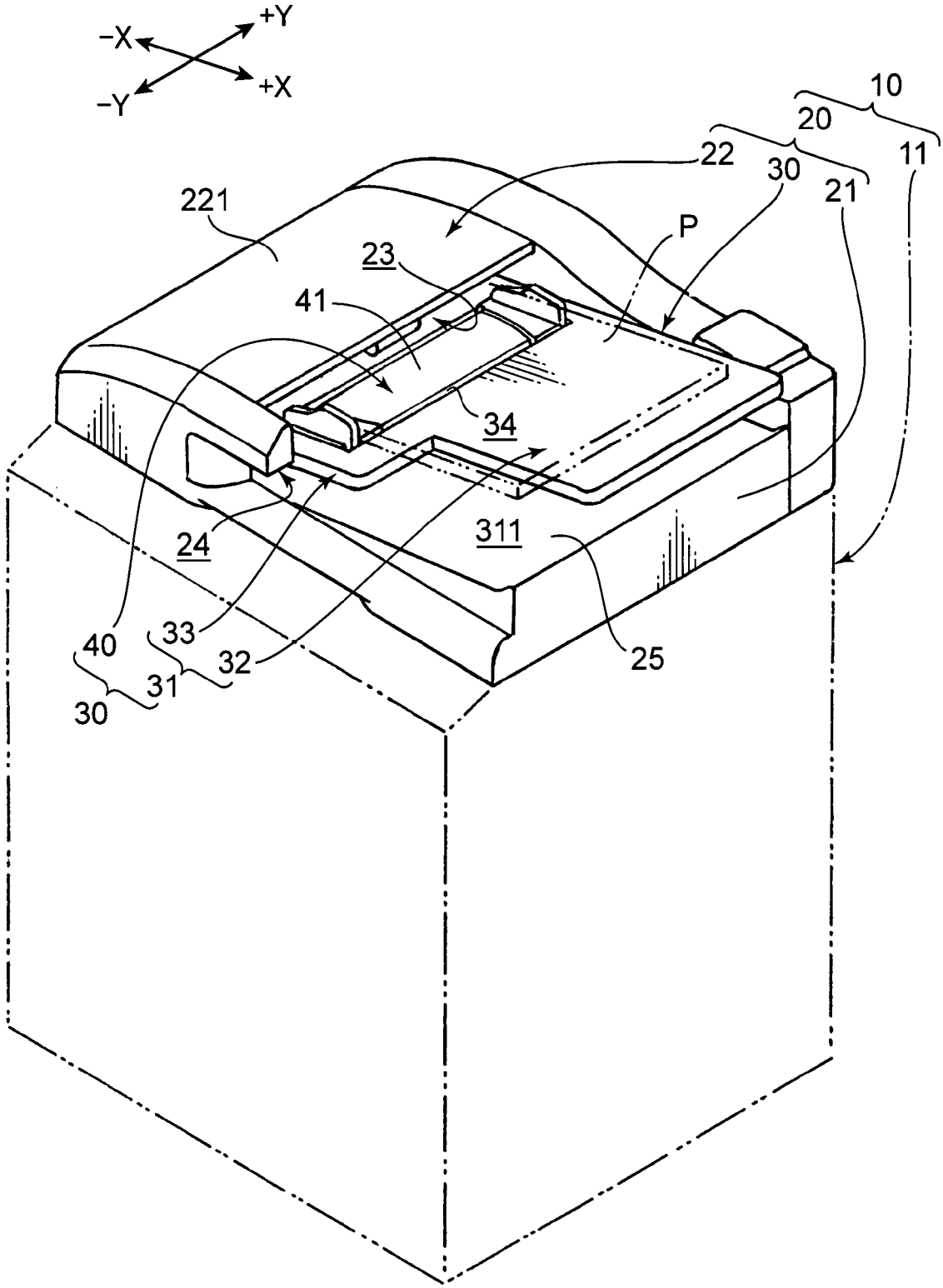
FIG. 1 is a perspective view showing one example of a sheet feeder to which a sheet feed tray according to one embodiment of the invention is applied.

FIG. 1 is a perspective view showing one example of a sheet feeder 20 to which a sheet feed tray 30 according to one embodiment is applied. It should be noted that, in FIG. 1, X-X directions and Y-Y directions are respectively referred to as transverse directions and forward and backward directions, wherein, particularly, −X direction is leftward direction, +X direction rightward direction, −Y direction forward direction and +Y direction backward direction. As shown in FIG. 1, the sheet feeder 20 is applied as a component of a copier 10 as one type of an image forming apparatus.

The copier 10 is provided with an apparatus main body 11 in which various members for image formation are mounted, and the sheet feeder 20 arranged atop this apparatus main body 11. An image of a document (sheet) P fed by the sheet feeder 20 is read by an unillustrated optical member disposed at a top part of the apparatus main body 11. A specified image forming process is performed in an unillustrated image forming unit based on the read image, and a transfer sheet stored in an unillustrated transfer sheet storing unit is fed to the image forming unit, whereby an image based on the image forming process is transferred to the transfer sheet.

The sheet feeder 20 includes a cover member 21 having a rectangular plan view and adapted to cover the upper surface of the apparatus main body 11, an image reader 22 bulging upward at a substantially left half of the cover member 21, and the sheet feed tray 30 mounted in the image reader 22 in such a state as to project to right from the right end surface of this image reader 22. The rear bottom edge of the sheet feeder 20 is coupled to the top part of the apparatus main body 11 via unillustrated hinge members. The sheet feeder 20 is turned back and forth about these hinge members, thereby being displaceable between a closing posture to close the top part of the apparatus main body 11 and an opening posture to open this top part.

An unillustrated contact glass is fitted in the top part of the apparatus main body 11. Upon reading an image, for example, from a book document, the sheet feeder 20 (cover member 21) is opened once to place the document on the contact glass and, successively, a document surface of the document placed on the contact glass is read with the cover member 21 closed.

The sheet feed tray 30 is mounted on the upper part of the right surface of the image reader 22. A sheet feed opening 23 through which the document P is fed into the image reader 22 is defined between the upper surface of the left side of the sheet feed tray 30 and a ceiling plate 221 of the image reader 22.

A sheet discharge tray 25 for receiving the document P having the image read by the image reader 22 is formed on the upper surface of the cover member 21 right below the sheet feed tray 30. A sheet discharge opening 24 is formed at a position of the right surface of the image reader 22 below the sheet feed tray 30. The document P having the image read is discharged to the sheet discharge tray 25 through this sheet discharge opening 24.

The sheet feed tray 30 includes a tray main body 31 L-shaped in plan view, and a side-fence retaining member 40 provided at the left side of the tray main body 31 and elongated in forward and backward directions. A front right corner portion of the tray main body 31 is cut out to form a hook-shaped cutout portion 311, whereby the tray main body 31 is L-shaped in plan view. By forming the cutout portion 311, a user can easily place the document P holding in hand on the sheet feed tray 30 and remove it from the sheet feed tray 30.

The tray main body 31 includes a leading-side tray main body 32 having a width thereof in forward and backward directions shortened by forming the cutout portion 311, and a base-side tray main body 33 located at the left side of the leading-side tray main body 32 and having a longer width in forward and backward directions than the leading-side tray main body 32. The width of the base-side tray main body 33 in forward and backward directions is set slightly shorter than that of the sheet feed opening 23. The sheet feed tray 30 is mounted into the image reader 22 by fitting the base-side tray main body 33 into the sheet feed opening 23.

The base-side tray main body 33 is formed with a mounting recess 34 which is flat and has a rectangular plan view longer in forward and backward directions and into which the side-fence retaining member 40 is fittable. The depth of this mounting recess 34 is set such that the upper surface of the side-fence retaining member 40 fitted in the mounting recess 34 is flush with the upper surface of the tray main body 31. The side-fence retaining member 40 can be stably mounted in the tray main body 31 by being fitted into the mounting recess 34. With a bottom plate 41 fitted in the mounting recess 34, small clearances are defined between the left and right edges of the mounting recess 34 and those of the bottom plate 41. Thus, parts of supporting members 60 to be described in detail later are movable in forward and backward directions through these clearances.

Figure 2:
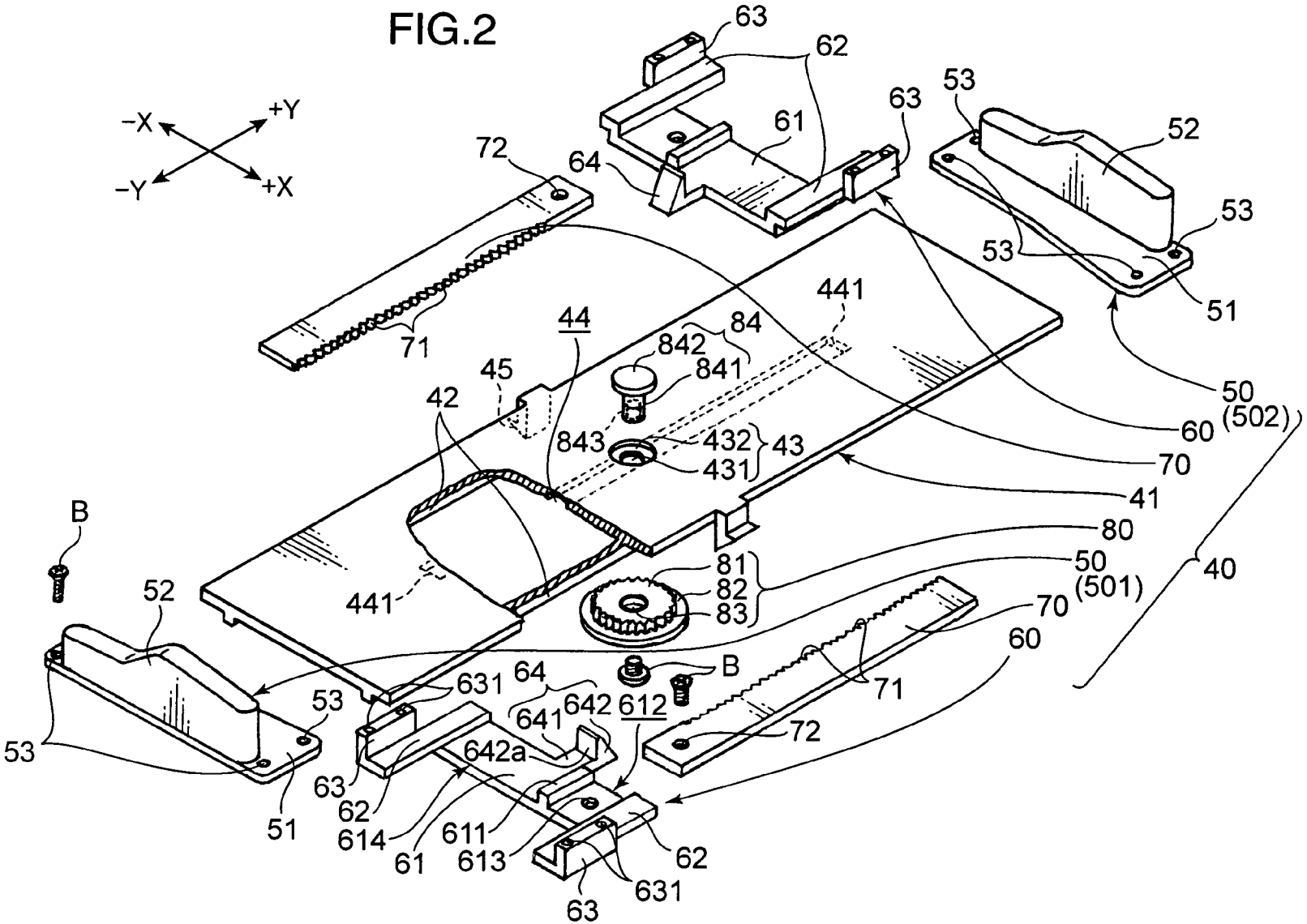
FIG. 2 is an exploded perspective view partly cut away showing one embodiment of a side-fence retaining member.
Figure 3:
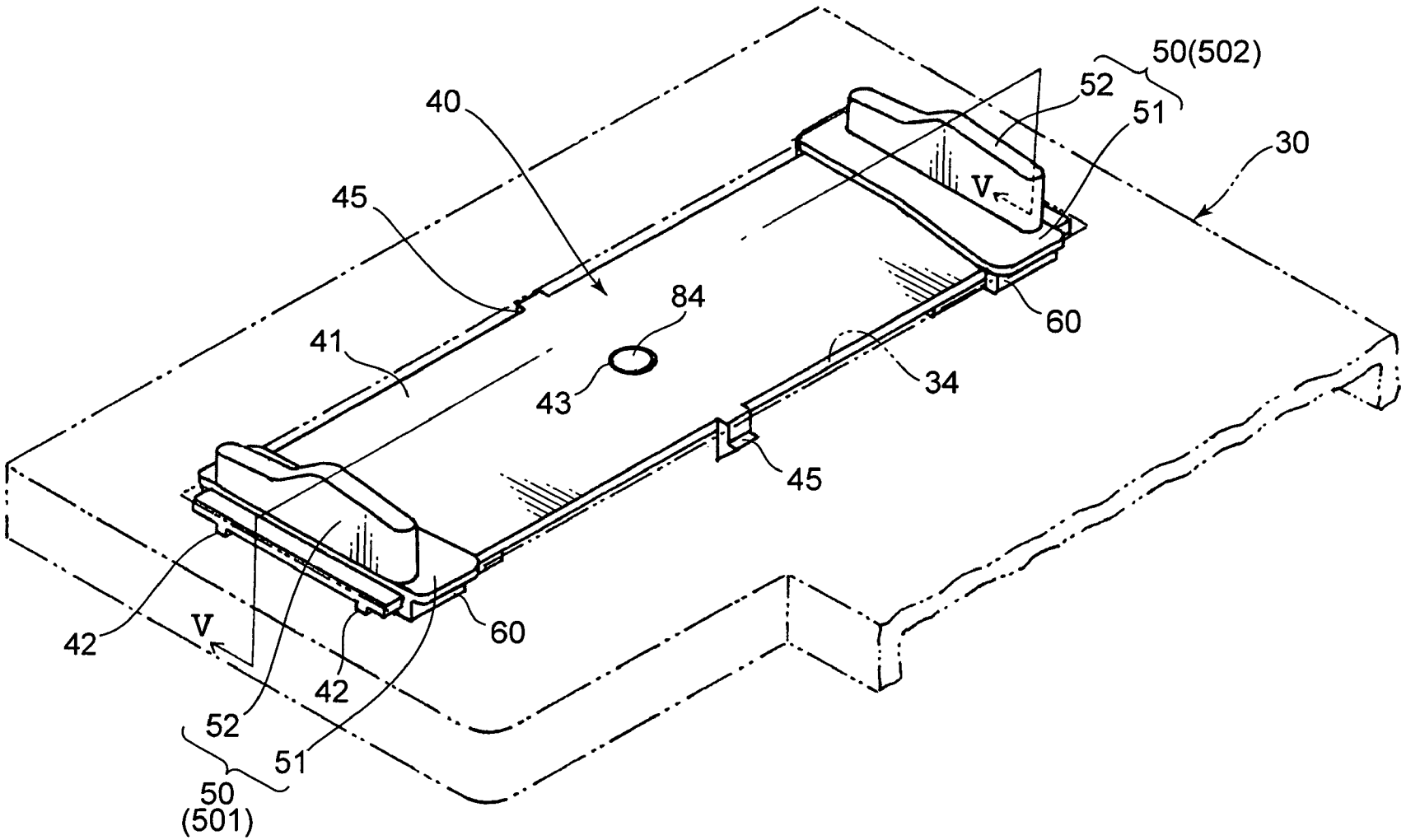
FIG. 3 is an assembled perspective view of the side-fence retaining member shown in FIG. 2.
Figure 4:
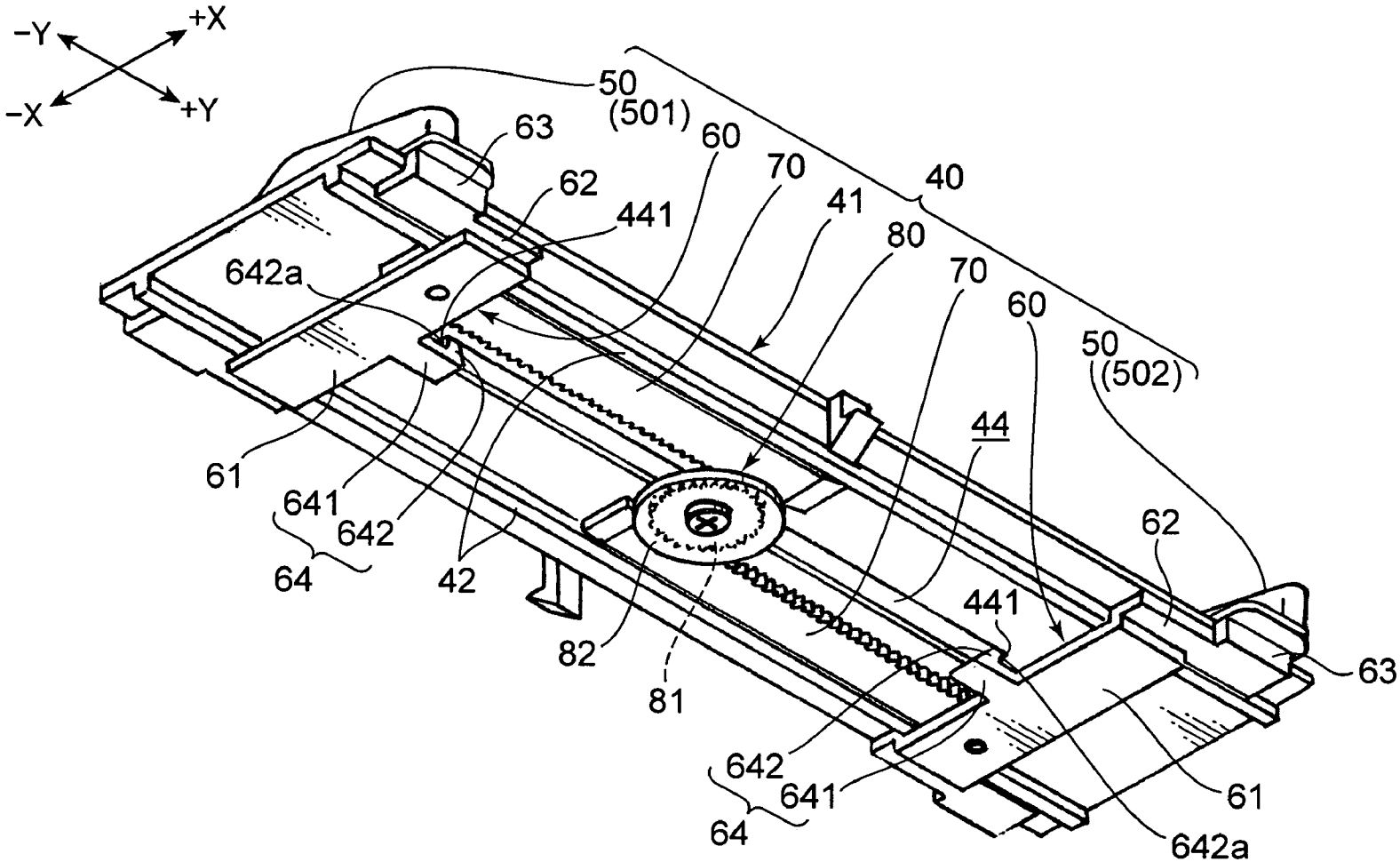
FIG. 4 is a perspective view of the side-fence retaining member shown in FIG. 3 when viewed from below.
Figure 5:
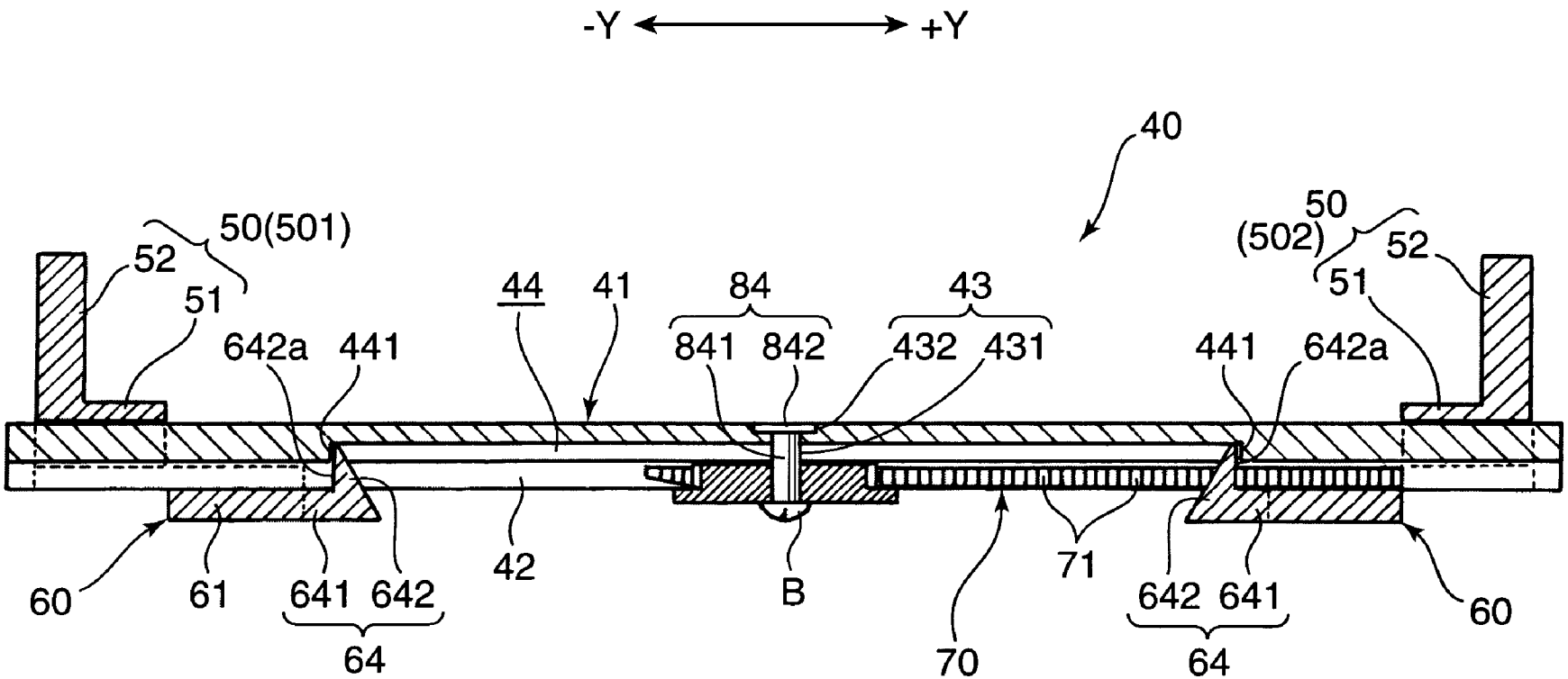
FIG. 5 is a section along V-V of the side-fence retaining member shown in FIG. 3.

FIG. 2 is an exploded perspective view partly cut away showing one embodiment of the side-fence retaining member 40, FIG. 3 is an assembled perspective view of this side-fence retaining member 40, FIG. 4 is a perspective view showing the side-fence retaining member 40 shown in FIG. 3 when viewed from below and FIG. 5 is a section along V-V of the side-fence retaining member 40 shown in FIG. 3. It should be noted that directions indicated by X and Y in FIGS. 2 to 5 are similar to the case of FIG. 1 (X are transverse directions (−X: leftward direction, +X: rightward direction) and Y are forward and backward directions (−Y: forward direction, +Y: backward direction)).

As shown in FIG. 2, the side-fence retaining member 40 includes the bottom plate 41, side fence members 50, the supporting members 60, racks 70 and a pinion member 80. Documents P are placed on the bottom plate 41. A pair of front and rear side fence members 50 are so mounted on the bottom plate 41 as to be movable in forward and backward directions. A pair of front and rear supporting members 60 are arranged at the underside of the bottom plate 41 such that the pair of side fence members 50 can be so supported as not to be detached from the bottom plate 41. A pair of front and rear racks 70 are fixed to the corresponding supporting members 60 at the underside of the bottom plate 41. The pinion member 80 is mounted in the middle of the underside of the bottom plate 41 while being engaged with the pair of racks 70.

The size of the bottom plate 41 in plan view is so set as to be fittable into the mounting recess 34 of the tray main body 31 (see FIG. 1). A pair of guide rails 42 parallel to each other are so arranged at the underside of the bottom plate 41 as to extend over the entire length in forward and backward directions while being spaced apart in transverse direction by a specified distance.

Further, a through hole 43 through which a pinion shaft 84 is inserted to attach the pinion member 80 to the bottom plate 41 is formed in the middle of the bottom plate 41. This through hole 43 is comprised of a small-diameter hole 431 and a large-diameter hole 432 formed concentrically with the small-diameter hole 431 in the upper surface of the bottom plate 41 and having a larger diameter than the small-diameter hole 431.

A recessed groove 44 extending in forward and backward directions is formed at a transverse middle position of the underside of the bottom plate 41. This recessed groove 44 extends forward and backward by the same distance from the center of the bottom plate 41 with respect to forward and backward directions (specifically, from the center of the through hole 43). End walls (contact portions) 441 for hindering the side fence members 50 from moving any further outward are formed at the front and rear ends of such a recessed groove 44. Accordingly, the pair of side fence members 50 are maximally spaced apart with outward movements of both front and rear side fence members 50 hindered by the end walls 441.

In addition, hooks 45 each having a locking claw projecting outward project downward at middle positions of the left and right edges of the bottom plate 41 with respect to forward and backward directions. These hooks 45 are engaged with unillustrated locking holes formed at the corresponding edges of the mounting recess 34 by fitting the bottom plate 41 into the mounting recess 34 (see FIG. 1) of the tray main body 31. In this way, the detachment of the bottom plate 41 from the mounting recess 34 can be prevented.

The pair of side fence members 50 are for holding the document P placed on the bottom plate 41 therebetween and guiding the document P to the image reader 22 while preventing displacements of the document P in width direction. The respective side fence members 50 are a front side fence member 501 and a rear side fence member 502 that are arranged in mirror-image symmetry with respect to forward and backward directions. Since the front and rear side fence members 501, 502 are identically constructed except that they are in mirror-image symmetry, components thereof are identified by the same reference numerals in the following description.

Each of the front and rear side fence members 501, 502 includes a fence supporting plate 51 to be slidably placed in close contact with the upper surface of the bottom plate 41, having a substantially rectangular plan view and elongated in transverse direction, and a side fence 52 standing on the fence supporting plate 51 and extending in transverse direction. The length of the fence supporting plate 51 in transverse direction is set slightly longer than the width of the bottom plate 41 in transverse direction. Thus, the fence supporting plate 51 bulges out to the left and right from the bottom plate 41 while being placed on the bottom plate 41.

The side fences 52 are for holding the document P placed on the bottom plate 41 in a pair. A substantially transverse middle part of each side fence 52 bulges upward and an arcuate edge portion extends obliquely downward to the left from the top of the bulged-out part along a concave curve, thereby making the side fence 52 excellent in design.

The side fence 52 extends in transverse direction at a front position of the fence supporting plate 51 in the front side fence member 501 while extending in transverse direction at a back position of the fence supporting plate 51 in the rear side fence member 502.

In each side fence member 50 constructed as above, through holes 53 are formed at four corners of the fence supporting plate 51. The side fence member 50 is mounted on the corresponding supporting member 60 by inserting screws B through the through holes 53 and spirally engaging the screws B with internally threaded holes 631 of the supporting member 60 to be described later.

The supporting members 60 are for supporting the side fence members 50 placed on the bottom plate 41 lest the side fence members 50 should be detached from the bottom plate 41. Each supporting member 60 includes a bridging plate 61, sliding contact pieces 62 and connecting pieces 63.

The bridging plate 61 is a member that is elongated in transverse direction and is mounted to span between the pair of guide rails 42 arranged on the underside of the bottom plate 41 and extending in forward and backward directions while being held in sliding contact therewith. The sliding contact pieces 62 are a pair of left and right members that are elongated in forward and backward directions and have the surfaces thereof facing each other held in sliding contact with the outer wall surfaces of the pair of guide rails 42. The sliding contact pieces 62 extend in opposite directions from the upper surfaces of the left and right ends of the respective bridging plates 61. The connecting pieces 63 are a pair of members that project upward from the corresponding sliding contact pieces 62 to slidably hold the bottom plate 41 therebetween and are used to mount the side fence members 50.

A distance between the inner surfaces of the sliding contact pieces 62 is set slightly larger than a distance between the outer surfaces of the pair of guide rails 42. Thus, the supporting member 60 is movable in forward and backward directions while being guided by the guide rails 42 by engaging the pair of sliding contact pieces 62 with the pair of guide rails 42.

The connecting pieces 63 are formed with the internally threaded holes 631 at positions facing the four through holes 53 formed in the fence supporting plate 51 of the side fence member 50. The side fence member 50 is mounted on the supporting member 60 by inserting the screws B through the respective through holes 53 and spirally engaging the screws B with the internally threaded holes 631 for tightening with the fence supporting plate 51 placed on the pair of connecting pieces 63.

Each bridging plate 61 is formed with a rib 611 extending in forward and backward directions at a position slightly to the right from the transverse center with the supporting member 60 oriented such that the sliding contact pieces 62 extend forward from the bridging plate 61. A mounting recess 612 for fixing the corresponding rack 70 is formed between the rib 611 and the sliding contact piece 62 closer to the rib 611. On the other hand, a sliding contact recess 614 for receiving the mating rack 70 while being held in sliding contact therewith is formed between the rib 611 and the sliding contact piece more distant from the rib 611.

Further, at a transverse middle position of the bridging plate 61, a locking projection 64 projects from the edge of the bridging plate 61 opposite to the one where the sliding contact pieces 62 project in a direction opposite to the projecting direction of the sliding contact pieces 62. The locking projection 64 is comprised of a tongue piece 641 projecting from the bridging plate 61 and a hooking piece 642 formed at the leading end of this tongue piece 641. A locking wall surface 642*a* projecting upward is formed at the base end of the hooking piece 642. Such a locking projection 64 is dimensioned such that the hooking piece 642 is fitted into the recessed groove 44 of the bottom plate 41 with the supporting member 60 attached to the bottom plate 41 as shown in FIG. 4.

That "the locking projection is disposed at the rack side" is defined in a claim of the present application. A concept of the rack side is used as opposed to the bottom plate side. In other words, it means that the locking projection 64 is not provided at the side of the bottom plate 41, but at the side of the rack 70 facing the bottom plate 41. A mode in which the locking projection 64 is disposed at the supporting member 60 integral to the rack 70 as in this embodiment falls under "disposed at the rack side".

The thus constructed supporting members 60 having a completely identical shape are employed for the front and rear side fence members 501, 502, and are mounted on the front and rear side fence members 501, 502 while having the orientations thereof changed so that the respective locking projections 64 facing each other.

Each rack 70 is elongated in forward and backward directions and includes a plurality of rack teeth (toothed surface) 71 formed at specified pitches at one of the edges thereof extending in longitudinal direction. The width of the rack 70 in transverse direction is set slightly smaller than that of the mounting recess 612 of the supporting member 60 so as to be fittable into the mounting recess 612.

A through hole 72 is formed at the base end of the rack 70 where no rack teeth 71 are formed. On the other hand, an internally threaded hole 613 corresponding to the through hole 72 is formed at the bottom of the mounting recess 612. The rack 70 is mounted on the supporting member 60 by inserting a screw B into the through hole 72 with the base end of the rack 70 fitted in the mounting recess 612 and spirally engaging this screw B with the internally threaded hole 613 for tightening.

The pinion member 80 is engaged with the pair of racks 70. The pinion member 80 includes a pinion 81 having a plurality of teeth formed at specified pitches on the outer circumferential surface thereof, and a flange 82 concentrically and integrally superimposed below the pinion 81 and having a diameter slightly larger than that of the pinion 81. An effective diameter of the pinion 81 is set such that the pinion 81 is engageable with the rack teeth of the pair of racks 70 facing each other at the underside of the bottom plate 41.

Such a pinion member 80 is formed with a center hole 83 at its center position, and is attached to the underside of a central part of the bottom plate 41 by inserting a pinion shaft 84 passed through the through hole 43 into this center hole 83.

On the other hand, the pinion shaft 84 includes a pinion-shaft main body 841 insertable into the small-diameter hole 431 of the through hole 43 formed in the bottom plate 41 while being held in sliding contact therewith, and a head portion 842 concentrically and integrally formed at the upper end of the pinion-shaft main body 841 and fittable into the large-diameter hole 432 of the through hole 43 while being held in sliding contact therewith. The pinion-shaft main body 841 has an internally threaded hole 843 concentrically formed in an end surface thereof opposite to the head portion 842. The pinion member 80 is mounted at a center position of the underside of the bottom plate 41 by spirally engaging a screw B with the internally threaded hole 843 for tightening with the center hole 83 thereof engaged with the pinion shaft 84 passed through the through hole 43.

As described above, in this embodiment, the pair of racks 70 provided for the respective side fences 52 via the supporting members 60 and the pinion member 80 engaged with these racks 70 are employed as an interlocking mechanism for interlocking a movement of one side fence 52 with that of the other side fence 52.

Next, the assembling of the side-fence retaining member 40 thus constructed is described. Upon assembling, two supporting members 60 and two racks 70 are first prepared. Subsequently, the base ends of the racks 70 are fitted in the mounting recesses 612 (see FIG. 2) formed on the bridging plates 61 of the respective supporting members 60 with the rack teeth 71 faced toward the locking projections 64, and then the screws B are inserted through the through holes 72 of the racks 70 and spirally engaged with the internally threaded holes 613 formed in the bottoms of the mounting recesses 612 for tightening. The thus obtained two supporting members 60 equipped with the racks 70 are respectively attached to the bottom plate 41.

The supporting members 60 are attached to the bottom plate 41 by fitting the pairs of sliding contact pieces 62 formed in the respective supporting members 60 to the pair of guide rails 42. By fitting the pairs of sliding contact pieces 62 to the pair of guide rails 42, the bottom plate 41 is tightly held between the pairs of connecting pieces 63 of the supporting members 60.

The side fence members 50 are placed on the top surface of the bottom plate 41 in this state to tightly hold the bottom plate 41 by the side fence members 50 and the supporting members 60. At this time, the hooking pieces 642 of the locking projections 64 disposed at the bridging plates 61 of the supporting members 60 are fitted into the recessed groove 44 of the bottom plate 41. Subsequently, the screws B are inserted through the respective through holes 53 formed at the four corners of each fence supporting plate 51 and spirally engaged with the internally threaded holes 631 formed in the respective connecting pieces 63 of each supporting member 60 for tightening, whereby the side fence members 50 and the supporting members 60 are attached to the bottom plate 41.

The respective side fence members 50 are moved in directions away from each other with the pair of side fence members 50 and the pair of supporting members 60 attached to the bottom plate 41. In this way, the locking wall surfaces 642*a* of the hooking pieces 642 of the respective supporting members 60 come into contact with the front and rear end walls 441 of the recessed groove 44 of the bottom plate 41, i.e. the respective side fence members 50 are maximally spaced apart as shown in FIG. 5.

In this state, the pinion shaft 84 is inserted through the through hole 43 of the bottom plate 41 from the top side, the center hole 83 of the pinion member 80 is fitted on the pinion-shaft main body 841 projecting from the underside of the bottom plate 41, and the pinion 81 is engaged with the rack teeth 71 of the respective racks 70 facing each other. Subsequently, the screw B is spirally engaged with the internally threaded hole 843 formed in the end surface of the pinion-shaft main body 841 for tightening. In this way, the pinion member 80 is attached to and retained at the central part of the underside of the bottom plate 41. The assembling of the side-fence retaining member 40 is thus completed.

Immediately after the side-fence retaining member 40 is assembled, the pair of side fence members 50 are held maximally spaced apart and positioned symmetrically at the front and rear sides with respect to the center position of the bottom plate 41. Accordingly, if either one of the side fence members 50 is moved thereafter, the other side fence member 50 is moved by the same distance in an opposite direction via the rack 70 and the pinion member 80, wherefore the respective side fences 52 are constantly located at symmetrical positions.

By fitting the side-fence retaining member 40 thus assembled into the mounting recess 34 of the tray main body 31, the pair of hooks 45 of the side-fence retaining member 40 are engaged with the opposite left and right edges of the mounting recess 34, whereby the sheet feed tray 30 as shown in FIG. 1 is completed.

As described in detail above, the sheet feed tray 30 according to this embodiment includes the bottom plate 41 on which the document P is placed, the pair of side fences 52 for positioning the opposite sides of the document P placed on the bottom plate 41 and facing each other in width direction normal to a conveyance direction of the document P, and the interlocking mechanism for interlocking movements of the pair of side fences 52 in directions toward and away from each other. The interlocking mechanism is comprised of the pair of racks 70 integrally attached to the respective side fences 52 with the rack teeth 71 opposed to each other and movable while facing the bottom plate 41, and the pinion 81 attached to the bottom plate 41 rotatably about its central axis and engaged with the pair of racks 70.

According to this construction, if one side fence 52 is moved in the width direction of a document P in conformity with the size of the document P upon placing the document P on the bottom plate 41 of the sheet feed tray 30, such a movement is transmitted to the other side fence 52 via one rack 70, the pinion 81 and the other rack 70. Thus, the other side fence 52 is moved by the same distance in a direction opposite to the one side fence 52. Therefore, both side fences 52 are positioned only by positioning one side fence 52, wherefore the side fences 52 can be easily positioned.

The locking projection 64 projecting toward the bottom plate 41 is disposed at each rack 70, whereas the bottom plate 41 is formed with the recessed groove 44. Further, the recessed groove 44 has the end walls 441 to be held in contact with the locking projections 64 with the respective side fences 52 maximally spaced apart. Thus, the pair of side fences 52 is maximally spaced apart by engaging the locking projections 64 with the end walls 441 upon assembling the sheet feed tray 30, and can be properly positioned relative to each other by assembling the pinion 81 in such a manner as to be engaged with the respective racks 70 in this state. Therefore, the phase alignment of the side fences 52 (centering of a document P to be fed) can be easily and properly performed.

Accordingly, the sheet feed tray 30 can be quickly and easily assembled with the pair of side fences 52 properly positioned without using a jig such as a scale. Thus, operability in assembling the side fences 52 can be remarkably improved and maintainability, for example, upon conducting a repair can also be improved.

The bottom plate 41 is recessed to form the recessed groove 44 into which the locking projections 64 are fitted and which extend in the moving directions of the side fences 52 and are formed with the end walls 441 as the contact portions. Thus, by fitting the locking projections 64 into the recessed groove 44, the side fences 52 can be moved back and forth within such a range that the locking projections 64 are movable within the recessed groove 44. Further, since the ends of the recessed groove 44 are used as the end walls 441, the respective side fences 52 can be easily positioned by bringing the respective locking projections 64 into contact with the end walls 441 of the recessed groove 44 upon assembling the sheet feed tray 30. Further, the racks 70 can be held in close contact with the bottom plate 41 since the locking projections 64 are fitted into the recessed groove 44, wherefore the total thickness of the racks 70 and the bottom plate 41 can be minimally held down.

The present invention is not limited to the foregoing embodiment and also embraces the following contents.

(1) Although the copier 10 is taken as an example of an apparatus, to which the sheet feed tray 30 is applied, in the description of the foregoing embodiment, the present invention is also applicable to other image forming apparatuses such as facsimile machines and printers.

(2) Although the sheet feed tray 30 is for feeding documents P to the image feeder 22 provided in the sheet feeder 20 in the foregoing embodiment, the sheet feed tray 30 may be for transfer sheets to which images are transferred. In this case, a sheet according to the present invention is a transfer sheet.

(3) In the foregoing embodiment, the recessed groove 44 is formed in the underside of the bottom plate 41 and the respective end walls 441 of this recessed groove 44 serve as contact portions according to the present invention. Instead of providing such a recessed groove 44, bottom-plate locking projections facing the locking projections 64 may be provided at the underside of the bottom plate 41.

(4) In the foregoing embodiment, the bottom plate 41 is formed with the recessed groove 44, whereas the supporting members 60 are provided with the locking projections 64. Instead, the racks 70 may be formed with recessed grooves, whereas the bottom plate 41 may be provided with locking projections fittable into these recessed grooves.

(5) In the foregoing embodiment, at the time of assembling the side-fence retaining member 40, the pinion member 80 is engaged with the respective racks 70 with the pair of side fences 52 positioned at a maximal distance from each other. Instead, the pinion member 80 may be engaged with the respective racks 70 with the pair of side fences 52 positioned at a minimum distance from each other.

(6) Although the pair of side fences 52 is positioned symmetrically with respect to the center position of the bottom plate 41 in the foregoing embodiment, they may not be positioned symmetrically.

The aforementioned specific embodiment mainly embraces features of the inventions having the following constructions.

A sheet feed tray according one aspect of the present invention comprises a bottom plate on which a sheet is to be placed; a pair of side fences for positioning the opposite widthwise sides of a sheet placed on the bottom plate; an interlocking mechanism for interlocking movements of the pair of side fences in directions toward and away from each other, the interlocking mechanism including a pair of racks integrally attached to the respective side fences with toothed surfaces thereof opposed to each other and movable along the bottom plate, and a pinion provided on the bottom plate rotatably about its central axis thereof and engageable with the pair of racks; locking projections disposed at the respective rack sides and projecting toward the bottom plate side; and contact portions disposed at the bottom plate side and engageable with the locking projections with the pair of side fences maximally or minimally spaced apart from each other.

An image forming apparatus according to another aspect of the present invention comprises an apparatus main body for applying an image forming process to a sheet; a sheet feeder attached to the apparatus main body to feed a sheet or a document to be read toward a specified position of the apparatus main body; and a sheet feed tray provided in the sheet feeder, adapted to bear the sheet or the document and having the inventive construction.

According to the above construction, the locking projections are disposed at the respective rack sides and the contact portion engageable with the locking projections with the respective side fences maximally or minimally spaced apart are disposed at the bottom plate side. Thus, upon assembling the sheet feed tray, the pair of side fences are maximally or minimally spaced apart by engaging the locking projections of the respective rack sides with the contact portions of the bottom plate side. By assembling the pinion to engage it with the respective racks in this state, the assembling of the sheet feed tray is completed while the relative positioning of the pair of side fences (phase alignment of the side fences) is properly performed.

Accordingly, the sheet feed tray can be quickly and easily assembled with the pair of side fences properly positioned without using a jig such as a scale, wherefore assembling operability is remarkably improved and maintainability, for example, upon conducting a repair can also be improved.

In the above construction, it is preferable that the bottom plate is recessed to form a recessed groove which extends in moving directions of the side fences and into which the locking projections are fittable, and that the contact portions are end walls formed at ends of the recessed groove.

With such a construction, by fitting the locking projections into the recessed groove, the side fences are moved back and forth within such a range that the locking projections are movable in the recessed groove. At the time of assembling the sheet feed tray, the respective locking projections can be engaged with the end walls of the recessed groove. Further, the racks can be closely attached to the bottom plate by fitting the locking projections into the recessed groove, wherefore the total thickness of the racks and the bottom plate can be maximally held down.

In the above construction, the contact portions are preferably bottom-plate side locking projections projecting from the bottom plate in correspondence with the locking projections.

With such a construction, the locking projections are engaged with the bottom-plate side locking projections projecting from the bottom plate at the time of assembling the sheet feed tray. It is sufficient to provide the bottom plate with the bottom-plate side locking projections as the contact portions, which contributes to a reduction in the production cost of the sheet feed tray.

A sheet feed tray according to another aspect of the present invention comprises a bottom plate on which a sheet is to be placed; a pair of side fences for positioning the opposite widthwise sides of a sheet placed on the bottom plate; an interlocking mechanism for interlocking movements of the pair of side fences in directions toward and away from each other, the interlocking mechanism including a pair of racks integrally attached to the respective side fences with toothed surfaces thereof opposed to each other and movable along the bottom plate, and a pinion provided on the bottom plate rotatably about its central axis thereof and engageable with the pair of racks; locking projections disposed at the bottom plate side and projecting toward the rack sides; and contact portions disposed at the respective racks and engageable with the locking projections with the pair of side fences maximally or minimally spaced apart from each other.

With such a construction as well, operability in assembling the side fences can be remarkably improved similar to the above.

This application is based on patent application No. 2006-053146 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet feed tray, comprising:

a bottom plate including a first surface on which a sheet is to be placed and a second surface opposite the first surface, the bottom plate further including first and second parallel sides extending along a width direction of the sheet to be placed thereon;

first and second side fences disposed on the first surface of the bottom plate for positioning opposite first and second widthwise sides of the sheet placed on the first surface of the bottom plate;

a first supporting member disposed on the second surface of the bottom plate and connected to the first side fence at positions outward from the first and second sides of the bottom plate;

a second supporting member disposed on the second surface of the bottom plate and connected to the second side fence at positions outward from the first and second sides of the bottom plate;

an interlocking mechanism for interlocking movements of the first and second side fences in directions toward and away from each other, the interlocking mechanism including a first rack integrally attached to the first supporting member and not formed integrally to the second supporting member, a second rack integrally attached to the second supporting member and not formed integrally to the first supporting member, the first and second racks being formed with toothed surfaces opposed to each other and being movable along the second surface of the bottom plate, and a pinion provided on the second surface of the bottom plate and being rotatable about a central axis of the pinion thereof, the pinion being engageable with both of the first and second racks;

locking projections disposed at the first and second supporting members and projecting toward the second surface of the bottom plate; and contact portions disposed at the second surface of the bottom plate and engageable with the locking projections with the first and second side fences maximally or minimally spaced apart from each other, wherein the second surface of the bottom plate is recessed to form a recessed groove which extends in moving directions of the first and second side fences and into which the locking projections are fittable, and the contact portions are end walls formed at ends of the recessed groove.

2. A sheet feed tray according to claim 1, wherein the recessed groove extends into the second surface of the bottom plate a distance less than a distance between the first and second surfaces of the bottom plate so that the locking projections engage the contact portions from a side of the second surface of the bottom plate.

3. A sheet feed tray according to claim 1, wherein the locking projections are engageable with the opposite ends of the recessed groove when the side fences are maximally spaced apart from each other.

4. A sheet feed tray according to claim 1, wherein each of the locking projections projects integrally from the respective supporting member.

5. A sheet feed tray according to claim 4, wherein the supporting members of the interlocking member are substantially identical to one another and are oriented oppositely from one another on the bottom plate.

6. A sheet feed tray, comprising:

a bottom plate including a first surface on which a sheet is to be placed and a second surface opposite the first surface, the bottom plate further including first and second parallel sides extending along a width direction of the sheet to be placed thereon;

first and second side fences disposed on the first surface of the bottom plate for positioning opposite first and second widthwise sides of the sheet placed on the first surface of the bottom plate;

a first supporting member disposed on the second surface of the bottom plate and connected to the first side fence at positions outward from the first and second sides of the bottom plate;

a second supporting member disposed on the second surface of the bottom plate and connected to the second side fence at positions outward from the first and second sides of the bottom plate;

an interlocking mechanism for interlocking movements of the first and second side fences in directions toward and away from each other, the interlocking mechanism including a first rack integrally attached to the first supporting member and not formed integrally to the second supporting member, a second rack integrally attached to the second supporting member and not formed integrally to the first supporting member, the first and second racks being formed with toothed surfaces opposed to each other and being movable along the second surface of the bottom plate, and a pinion provided on the second surface of the bottom plate and being rotatable about a central axis of the pinion thereof, the pinion being engageable with both of the first and second racks;

first and second bottom plate locks disposed adjacent the second surface of the bottom plate; and first and second contact portions disposed at the respective first and second supporting members and being engageable respectively with the first and second bottom plate locks when the side fences maximally or minimally spaced apart from each other.

7. An image forming apparatus, comprising:

an apparatus main body for applying an image forming process to a sheet;

a sheet feeder attached to the apparatus main body to feed the sheet toward a specified position of the apparatus main body; and a sheet feed tray provided in the sheet feeder and adapted to bear the sheet, wherein the sheet feed tray includes:

a bottom plate including a first surface on which the sheet is to be placed and a second surface opposite the first surface, the bottom plate further including first and second parallel sides extending along a width direction of the sheet to be placed thereon;

first and second side fences disposed on the first surface of the bottom plate for positioning opposite first and second widthwise sides of the sheet placed on the first surface of the bottom plate;

a first supporting member disposed on the second surface of the bottom plate and connected to the first side fence at positions outward from the first and second sides of the bottom plate;

a second supporting member disposed on the second surface of the bottom plate and connected to the second side fence at positions outward from the first and second sides of the bottom plate;

an interlocking mechanism for interlocking movements of the first and second side fences in directions toward and away from each other, the interlocking mechanism including a first rack integrally attached to the first supporting member and not formed integrally to the second supporting member, a second rack integrally attached to the second supporting member and not formed integrally to the first supporting member, the first and second racks being formed with toothed surfaces opposed to each other and being movable along the second surface of the bottom plate, and a pinion provided on the second surface of the bottom plate and being rotatable about a central axis of the pinion thereof, the pinion being engageable with both of the first and second racks;

locking projections disposed at the first and second supporting members and projecting toward the second surface of the bottom plate; and contact portions disposed at the second surface of the bottom plate and engageable with the locking projections with the first and second side fences maximally or minimally spaced apart from each other;

the second surface of the bottom plate is recessed to form a recessed groove which extends in moving directions of the first and second side fences and into which the locking projections are fittable, and the contact portions are end walls formed at ends of the recessed groove.

8. An image forming apparatus according to claim 7, wherein the recessed groove extends into the second surface of the bottom plate a distance less than a distance between the first and second surfaces of the bottom plate so that the locking projections engage the contact portions from a side of the second surface of the bottom plate.

9. An image forming apparatus according to claim 7, wherein the locking projections are engageable with the opposite ends of the recessed groove when the side fences are maximally spaced apart from each other.

10. An image forming apparatus according to claim 7, wherein each of the locking projections projects integrally from the respective supporting member.

11. An image forming apparatus according to claim 10, wherein the supporting members of the interlocking member are substantially identical to one another and are oriented oppositely from one another on the bottom plate.

12. An image forming apparatus, comprising:

an apparatus main body for applying an image forming process to a sheet;

a sheet feeder attached to the apparatus main body to feed the sheet toward a specified position of the apparatus main body; and a sheet feed tray provided in the sheet feeder and adapted to bear the sheet, wherein the sheet feed tray includes:

a bottom plate including a first surface on which the sheet is to be placed and a second surface opposite the first surface, the bottom plate further including first and second parallel sides extending along a width direction of the sheet to be placed thereon;

first and second side fences disposed on the first surface of the bottom plate for positioning opposite first and second widthwise sides of the sheet placed on the first surface of the bottom plate;

a first supporting member disposed on the second surface of the bottom plate and connected to the first side fence at positions outward from the first and second sides of the bottom plate;

a second supporting member disposed on the second surface of the bottom plate and connected to the second side fence at positions outward from the first and second sides of the bottom plate;

an interlocking mechanism for interlocking movements of the first and second side fences in directions toward and away from each other, the interlocking mechanism including a first rack integrally attached to the first supporting member and not formed integrally to the second supporting member, a second rack integrally attached to the second supporting member and not formed integrally to the first supporting member, the first and second racks being formed with toothed surfaces opposed to each other and being movable along the second surface of the bottom plate, and a pinion provided on the second surface of the bottom plate and being rotatable about a central axis of the pinion thereof, the pinion being engageable with both of the first and second racks;

first and second bottom plate locks disposed adjacent the second surface of the bottom plate; and first and second contact portions disposed at the respective first and second supporting members and being engageable respectively with the first and second bottom plate locks when the side fences maximally or minimally spaced apart from each other.

* * * * *